US006905189B1

(12) United States Patent
Duffield

(10) Patent No.: US 6,905,189 B1
(45) Date of Patent: Jun. 14, 2005

(54) WET CAPPING TRAY FOR INK JET PRINTHEADS

(75) Inventor: John P. Duffield, Meredith, NH (US)

(73) Assignee: Vutek, Inc., Meredith, NH (US)

( * ) Notice: Subject to any disclaimer, the term of this patent is extended or adjusted under 35 U.S.C. 154(b) by 0 days.

(21) Appl. No.: 10/440,447

(22) Filed: May 16, 2003

Related U.S. Application Data

(60) Provisional application No. 60/381,124, filed on May 16, 2002.

(51) Int. Cl.[7] ..... B41J 2/165

(52) U.S. Cl. ..... 347/28; 347/27; 347/35

(58) Field of Search ..... 347/22, 28, 29, 347/35, 27

(56) References Cited

U.S. PATENT DOCUMENTS 4,849,769 A * 7/1989 Dressler ..... 347/27
4,853,717 A 8/1989 Harmon et al.
5,027,134 A 6/1991 Harmon et al.
5,055,856 A 10/1991 Tomii et al.
5,115,250 A 5/1992 Harmon et al.
5,339,102 A 8/1994 Carlotta
5,404,158 A 4/1995 Carlotta et al.
5,412,411 A 5/1995 Anderson
5,534,896 A 7/1996 Osborne
5,563,637 A 10/1996 Francis et al.
5,570,117 A 10/1996 Karambelas et al.
5,635,965 A 6/1997 Purwins et al.
5,923,347 A 7/1999 Wade
5,963,228 A 10/1999 Purwins
6,068,364 A 5/2000 Kusumi et al.
6,135,585 A 10/2000 Johnson et al.
6,164,752 A 12/2000 Schaefer et al.
6,309,044 B1 10/2001 Gaarder
6,312,091 B1 11/2001 Quintana

* cited by examiner

*Primary Examiner*—Shih-Wen Hsieh
(74) *Attorney, Agent, or Firm*—Hamilton, Brook, Smith & Reynolds, P.C.

(57) ABSTRACT

A printing system that includes a printhead head containing ink, and a tray cooperatively associated with the printhead and containing a waste solution in which the printhead is immersed to seal the printhead to prevent the ink from clogging the printhead when the printing system is not in operation.

23 Claims, 4 Drawing Sheets

WET CAPPING TRAY FOR INK JET PRINTHEADS

RELATED APPLICATION

This application claims the benefit of U.S. Provisional Application No. 60/381,124, filed May 16, 2002, the entire teachings of which are incorporated herein by reference.

BACKGROUND

In certain large-scale printing systems, printheads are used to eject ink onto a substrate to create the desired image, for example, on substrates such as museum displays, billboards, sails, bus boards, and banners. In some of these printing systems, the printheads receive ink from an ink supply or reservoir and use a so-called drop on demand ink jet process. With this type of process, ink is ejected from one or more nozzles of the printheads when a piezoelectric crystal in the printhead is actuated. The piezoelectric crystal generates a pulse in the ink so that the ink expels through the nozzle as a droplet. To create the image, a carriage which holds one or more printheads scans or traverses across the substrate while the printheads deposit ink as the substrate moves.

Regardless of the particular type of printing system in which the ink jet printheads are used; the printheads commonly have a series of manifolds and channels that transport the ink to the nozzles. As such, a particular concern for these printheads when the printing system is not in operation is that the ink in the manifolds and channels can harden. That is, water-based inks, as well as solvent-based inks can dry out, or the ink can polymerize if the ink happens to be UV curable. Thus, when the printheads are not in use, it is desirable to somehow seal the printheads to prevent exposing the ink in the printheads to air and/or to UV radiation.

Some have proposed sealing the nozzles of the printheads with a plastic sheet, while others have proposed placing a wet pad soaked with a flushing solvent, such as a solution made of water and glycol ether, against the nozzles when the printheads are not being used. These printhead capping processes are somewhat effective for short periods of time, say, for example, up to one day. However, the performance of these processes has been less than desirable for longer periods of time, for example, three to four days, since it is difficult to keep the printheads completely sealed for these longer periods.

Others have proposed introducing a model solution, such as polypropylene glycol, into the printheads to seal them when the printing system is not in operation. Typically, such solutions are used for shipping or storing the printheads for long periods of time, for example, weeks or months. However, it takes hours and sometimes days to flush the model solution out of the printheads before using them in a printing operation, which may be impractical if the printing system is only inoperative for a few days.

SUMMARY

For solvent-based inks, if the ink happens to dry out in a printhead, the ink can typically be redissolved so that the printhead can be recovered. However, for waterbased inks, once the ink drys out and hardens, or for UV-curable inks, once the ink polymerizes, it becomes very difficult to salvage the printheads.

As for capping processes which use wet pads to seal the printheads, particularly for water-based inks, the pads are typically made of textile fibers which can break off and enter the nozzles and plug them up. Furthermore, these stray fibers can serve as initiation sites for the ink to dry out and harden.

Therefore a need exists for a method and apparatus which is able to seal the printheads of a printing system to prevent exposing the ink in the printheads to air and/or UV radiation when the printing system is not in operation. Furthermore, the sealing process must occur rather quickly, especially if the ink is water-based or UV curable.

The present invention relates to an apparatus and method of sealing printheads efficiently and quickly with a wet capping station, in particular, a wet capping tray, when the printheads are not being used, for example, during the time period between printing operations.

In one aspect of the invention, a printing system includes a printhead containing ink, and a tray cooperatively associated with the printhead and containing a solution in which the printhead is immersed to seal the printhead to prevent the ink from clogging the printhead when the printing system is not in operation. The solution can be any suitable solution that is compatible with the printhead and the ink, and the solution may be provided to the tray from any convenient source.

Embodiments of this aspect can include one or more of the following features. The solution can be a waste solution made of a single colored ink emitted from a single printhead. There can be a plurality of printheads immersed in the waste solution. Thus, the waste solution can be a single colored ink emitted from one or more of the plurality of printheads, or the waste solution can be made from different colored inks emitted from the plurality of printheads. Additionally or alternatively, the waste solution can be made of a flushing solvent used to clean and purge the printheads.

To effectively seal the printheads in a short period of time, the wet capping station in some embodiments includes an actuator that moves the tray towards the printheads to immerse them in the waste solution.

The tray can have a basin that contains the waste solution. The tray can include a valve in fluid communication with the basin, in which case the valve is partially or fully opened to allow a desired amount of the waste solution to drain from the basin, and is closed to prevent the waste solution from draining from the basin. The valve can be adjustable to allow the waste solution to drain from the basin at a desired flow rate.

In particular embodiments, the tray has a first pair of oppositely opposed sidewalls that are substantially parallel to each other, a second pair of oppositely opposed sidewalls that are also substantially parallel to each other, and a base. The first pair of sidewalls, the second pair sidewalls, and the base define a basin in which the waste solution is contained.

In some embodiments, each of the sidewalls of the first pair of sidewalls is provided with one or more slots which engage with a respective head of a screw that is used to secure the printhead to a carriage. The slot can have a semi-circular shape with an opening that faces the basin.

In other embodiments, each of the sidewalls of the first pair of sidewalls is provided with at least one hole that engages with the head of a respective screw.

In another aspect of the invention, a method of immersing one or more printheads in a waste solution includes emitting ink from one or more printheads into a tray, so that the emitted ink in the tray is a waste solution, and immersing the one or more printheads in the waste solution.

Embodiments of this aspect of the invention can include one or more of the following features. Prior to immersing the printheads, a flushing solution is emitted from one or more printheads into the tray. Thus, the waste solution is made of the ink, as well as the flushing solution. The ink can be emitted from one or more printheads. The waste solution can contain different colored inks emitted from a plurality of printheads. The method can include moving the tray with the waste solution towards the printheads to immerse the printheads in the waste solution. In particular embodiments, the waste solution is periodically drained from the tray.

Some of the embodiments may include one or more of the following advantages. The cleaning station provides a relative quick way of sealing the printheads, particularly when the printing system is not in operation over period of days. The cleaning station provides a simple quick, process of immersing the printheads in the waste solution and then extracting the printheads for subsequent printing operations with a simple mechanism.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows. These embodiments are provided by way of example and not as limitations of the invention.

Figure 1:
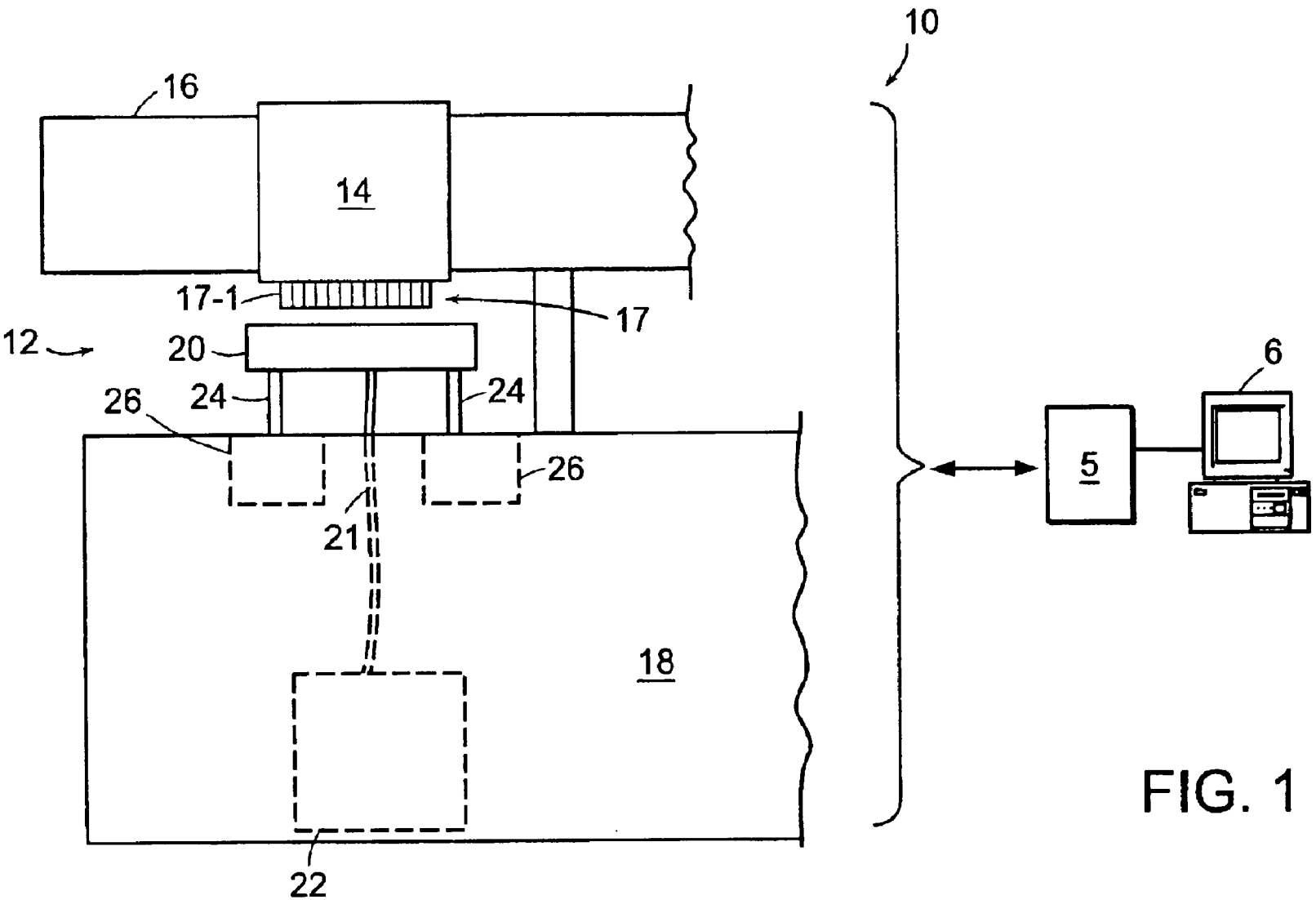
FIG. 1 is a partial view of a printing system with a cleaning station.

Referring to FIG. 1, there is shown a partial view of a printing system 10 with a cleaning/purging station 12. The printing system 10 includes a carriage 14 that moves back and forth along a rail 16 mounted to a base 18. As the carriage 14 traverses along the rail 16, one or more printheads of a set of printheads 17 deposit ink onto a substrate that moves beneath the carriage 14. The operation and features of a printing system like the one shown in FIG. 1 is described in greater detail in U.S. patent application Ser. No. 09/834,999, filed Apr. 13, 2001, the entire contents of which are incorporated herein by reference.

A particular feature of the printing system 10 is the cleaning/purging station 12 positioned beneath the carriage 14, and hence the set of printheads 17, when the carriage 14 is in a rest position, which may occur between printing operations. Typically, during these down periods, an operator interacts with a controller 5 of the printing system through, for example, a minicomputer 6 to instruct the printing system 10 to pump a flushing solvent through the printheads 17. The flushing solution is used to clean and purge the printheads, and is collected in a trough 20 as it ejects from the nozzles. From the trough 20, the cleaning solution flows through a tube 21 connected to the bottom of the trough to a waste container 22 typically located within the base 18. Moreover, for example, after a rest period and prior to the start of a new print operation, the printheads under the direction of the controller 5 may eject ink to prime the printheads. This waste ink is also collected in the trough 20 from where it drains through the tube 21 to the waste container 22.

As shown in FIG. 1, the trough 20 is mounted to a pair of legs 24 that arc connected to a pair of actuators 26 positioned within the base 18. The actuators in one embodiment are air cylinders which raise and lower the legs 24, and hence the trough 20, and to position the trough 20 a desired distance from the set of printheads 17 by filling and removing air from the air cylinders.

Figure 2B:
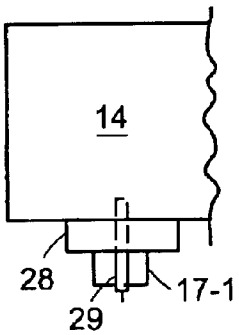
FIG. 2B is an end view of the carriage and printhead of FIG. 2A.
Figure 2A:
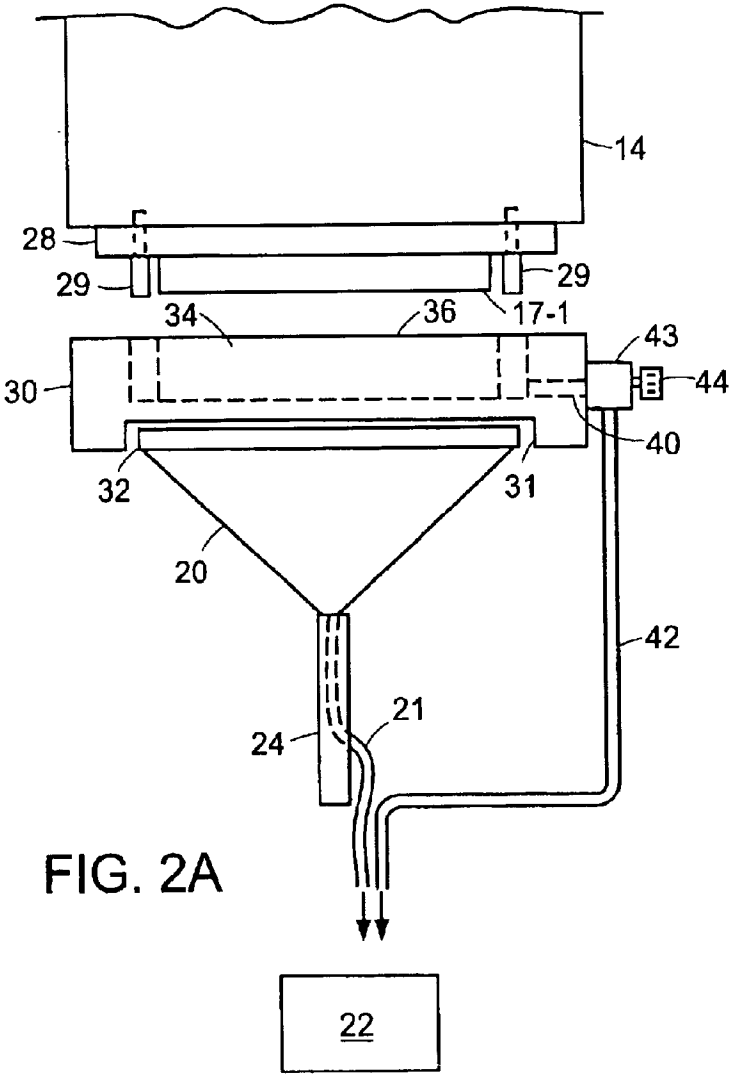
FIG. 2A is a side view of the cleaning station of FIG. 1 with a wet capping tray shown with a carriage and printhead in accordance with the invention.

Referring now to FIG. 2A, there is shown a close-up side view of the cleaning/purging station 12 and the printheads 17, of which only a first printhead 17-1 is illustrated because of the orientation of the printheads. As shown in FIGS. 2A and 2B, the printhead 17-1 is mounted to a bezel 28 which is attached to the carriage 16 with a pair of screws 29.

Figure 3B:
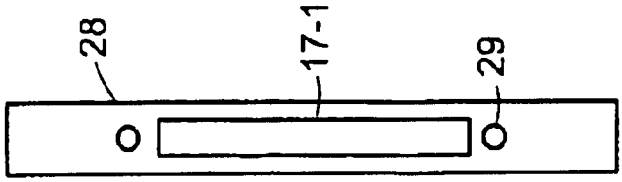
FIG. 3B is a bottom view of the printhead of FIG. 2A.
Figure 3A:
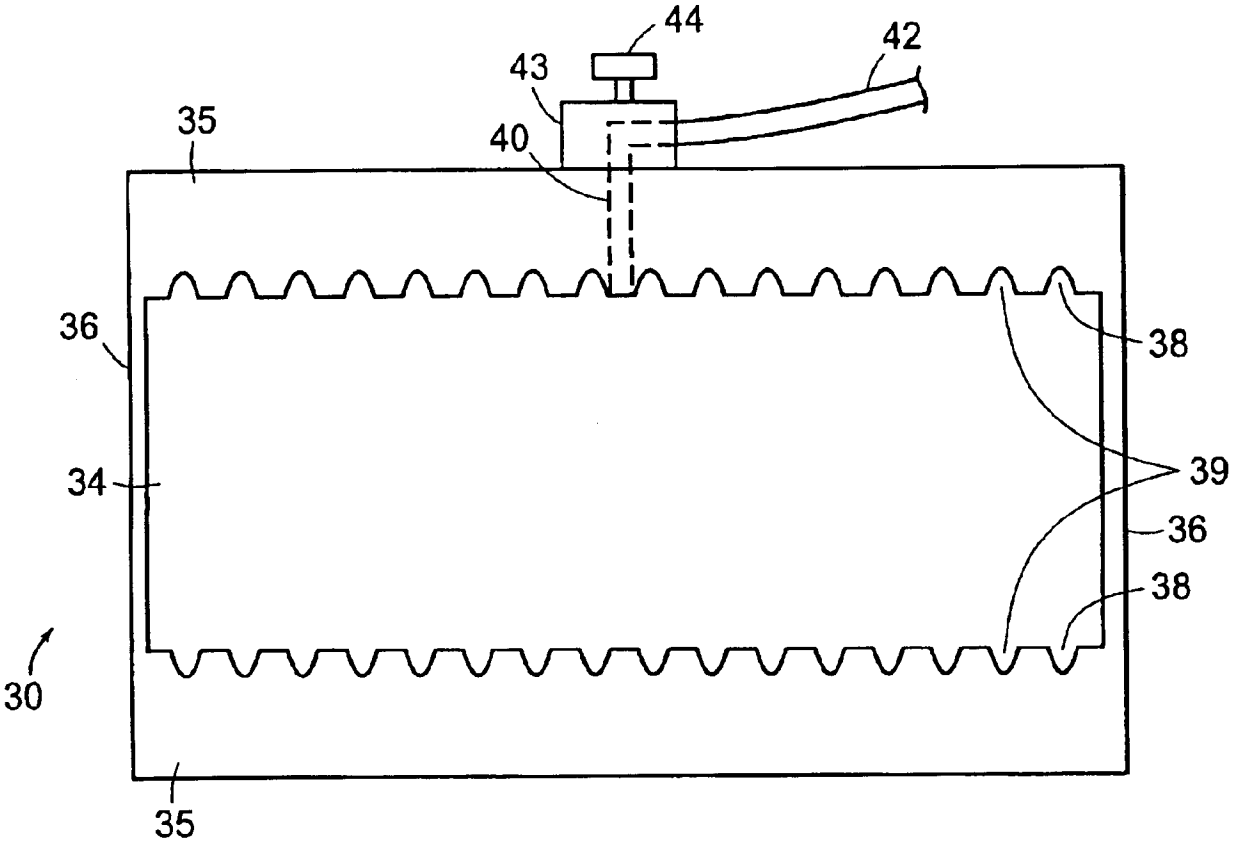
FIG. 3A is a top view of the wet capping tray of FIG. 2A.

When configured for sealing the printheads 17, the cleaning/purging station 12 includes a plate 32 placed on top of the trough 20, and a tray 30 mounted on top of the plate 32. The tray 30 has a recessed region 31 in which the plate 32 is positioned in a manner to prevent the tray 30 from moving and/or sliding off the plate 32, and hence the trough 20. The tray 30 also includes a basin 34 defined by a pair spaced apart sidewalls with ledges 35 (FIG. 3) that are substantially parallel to each other, and another pair of spaced apart side walls 36 orthogonal to the ledges 35 and substantially parallel to each other.

Attached to the side of the tray 30 is a valve 43 connected to a hole 40 of the tray 30, which opens to the basin 34 and to a drain tube 42. Accordingly, when an operator opens the valve 43, for example, with a knob 44, fluid contained in the basin 34 flows through the hole 40 and out through the drain tube 42. Furthermore, the operator can adjust the knob 44 to control the flow rate of the liquid from the basin 34.

The plate 32 is typically about 0.25 inch thick, about 26 inches long, and about 5 inches wide, and is made from a metal or plastic, or any other suitable stiff material. The tray 30 is typically made of a plastic or metal, depending on the compatibility with the ink, and is about 26 inches long and about 6 inches wide, and the basin is about 0.5 inch deep. In some embodiments, the tube 21 is made of a metal, and the tube 42 is a flexible hose made of a material that is compatible with the ink.

To seal the printheads 17 after a printing operation, an operator places the plate 32 on top of the trough 20, and the tray 30 on top of the plate 32. Then, under the direction of a controller 5, the carriage 14 moves along the rail 16 and positions the printheads 17 above the tray 30.

Subsequently, the controller 5 directs the printheads 17 to eject ink through their respected nozzles, such that the ink is collected in the basin 34 of the tray 30 as a waste solution. Moreover, in some circumstances a flushing solvent is pumped through the printheads 17 to clean and purge them. The ink and/or flushing solvent accumulates in the basin 34 to a depth of about 2 to 3 mm.

Next, the controller 5 activates the actuators 26 to move the trough 20 and hence the tray 30 towards the printheads 17. Note that along each ledge 35 there is a series of slots 38 (FIG. 3A) with openings 39 that face the basin 34. Typically, the number of slots 38 along each ledge 35 is equal to the number of printheads 17, so that as the tray 30 moves towards the printheads, each head of the screws 29 fits within a respective slot 38. Movement of the tray 30 stops when the face of the bezel 28 rests on top of the ledges 35. The slots 38 stabilize the tray 30 and prevent excess movement between the tray 30 and the printheads 17. In some embodiments, the printheads 17 are immersed in the waste solution of ink and/or flushing solvent to a depth of about 3 to 5 mm. That is, when printheads are immersed in the solution, the level of the waste solution rises to about 4 to 6 mm with the printheads about 1 mm off the bottom of the basin 34. It typically takes about five seconds from the moment the printheads 17 are positioned above the tray 30 to when they are immersed in the waste solution.

Once immersed in the waste solution, the printheads remain wet and sealed even if some of the waste solution evaporates over a period of a few days to prevent ink in the printheads from drying out and clogging the channels, manifolds, and nozzles of the printheads. Furthermore, when the printheads 17 are sealed with the liquid waste solution, the printheads do not rest on top of some fibrous materials as in certain prior art cleaning stations. Thus, there are no fibers that flow into the nozzles of the printheads 17 which can also clog the nozzles.

After the down time or rest period and at the start of the next printing operation, the operator interacts with the controller 5 to direct the actuators 26 to lower the trough 20, and hence the tray 30, away from the printheads 17. Subsequently, to prime the printheads 17 for the next printing operation, the printheads eject ink to clean out any of the waste solution that may have be drawn into the nozzles, channels, and manifolds of the printheads 17, for example, by capillary action.

Next, the operator turns opens the valve 43 with the knob 44 to drain the waste solution from the basin 34. The waste solution flows through the drain tube 42 which typically extends to the waste container 22 that is used to collect waste ink from the trough 20 through the tube 21. The waste container 22 is able to hold about four gallons of waste solution. Periodically, the operator removes the waste container 22 and empties it, or replaces it with a new waste container.

As discussed above, the head of the screws 29 fit within the slots 38 of the tray to hold the printheads 17 in place when the printheads are immersed in the waste solution. There are, however, other embodiments of the invention which fulfill the purpose of the slots 38.

Figure 4:
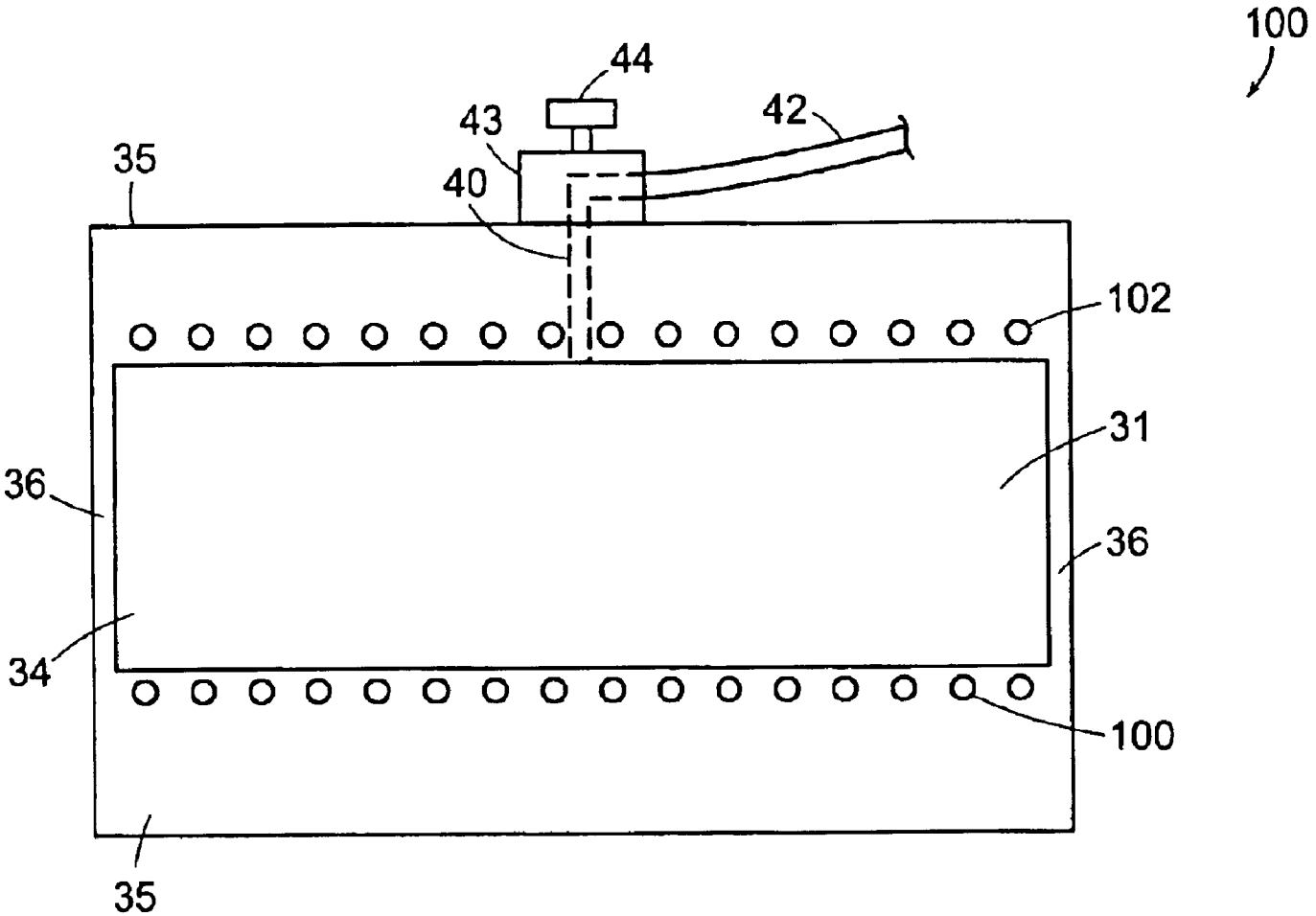
FIG. 4 is a top view of an alternative embodiment of a wet capping tray.

For example, as illustrated in FIG. 4, there is shown an alternative embodiment of a wet capping tray 100. Note that certain features of the tray 100 are identical to those of the tray 30, and therefore are identified by like numerals. However, rather than having slots 38 which have openings 39 that face towards the basin 34, as the tray 30, the tray 100 of FIG. 4 has a series of holes 102 in which the head of the screws 29 fit. As such, the series of holes 102 do not open up to the basin 34 so that the head of the screws 29 are not exposed to the waste solution when the printheads 17 are immersed in the solution. Hence, the screws 29 do not get any waste solution on them, which makes any required cleanup easier.

As with the tray 30, the tray 100 has a recessed region 31 in which the plate 32, placed on top of the trough 20, is positioned when the cleaning/wet capping station is used to seal the printheads 17. The tray 100 is used in much the same way as the tray 30 described above. Thus, in operation, as the actuators 26 move the tray 100 towards the printheads 17, the bead of the screws 29 fit inside the holes 102 of the tray 100 while the printheads 17 are immersed in the waste solution. Again, the actuators 26, under the direction of the controller 5, terminate the upward movement of the tray 100 when the bezel 28 makes contact with the ledges 35.

While this invention has been particularly shown and described with references to preferred embodiments thereof, it will be understood by those skilled in the art that various changes in form and details may be made therein without departing from the scope of the invention encompassed by the appended claims. For example, the waste solution can also be any suitable liquid that is compatible with both the ink and the printheads, such as, for example, water, and/or model fluid.

What is claimed is:

1. A printing system, comprising:

a printhead containing printing ink; and a tray cooperatively associated with the printhead and containing a solution in which the printhead is immersed to seal the printhead to prevent the ink from clogging the printhead when the printing system is not in operation; the printhead being adapted to emit a fluid into the tray prior to the immersion of the printhead into the solution.

2. The printing system of claim 1 wherein the solution comprises a waste solution comprising one or more liquids that are compatible with both the printing ink and the printhead.

3. The system of claim 2 wherein the waste solution includes ink emitted from the printhead.

4. The system of claim 2 wherein the waste solution includes a liquid from a source other than the printhead.

5. The system of claim 2 wherein the waste solution includes a flushing solution emitted from the printhead, the flushing solution being used to clean and purge the printhead.

6. The system of claim 1 wherein a plurality of printheads are immersed in the solution to prevent the printheads from drying out when the printing system is not in operation.

7. The system of claim 6 wherein the solution is made of ink emitted from each of the plurality of printheads.

8. The system of claim 7 wherein the waste solution is made of different colored inks emitted from the plurality of printheads.

9. The system of claim 7 wherein the waste solution is also made of a flushing solution emitted from one or more of the plurality of printheads, the flushing solution being used to clean and purge the printheads.

10. The system of claim 1 further comprising an actuator which moves the tray towards the printhead to immerse the at least one printhead in the solution.

11. The system of claim 1 wherein the tray has a basin, the solution being contained in the basin.

12. The system of claim 11 wherein the tray includes a valve in fluid communication with the basin, the valve being partially or fully opened to allow a desired amount of the waste solution to drain from the basin, and being closed to prevent the waste solution from draining from the basin.

13. The system of claim 12 wherein the valve is adjustable to allow the waste solution to drain from the basin at a desired flow rate.

14. The system of claim 1 wherein the tray has a first pair of oppositely opposed sidewalls that are substantially parallel to each other, a second pair of oppositely opposed sidewalls that are substantially parallel to each other, and a base, the first pair of oppositely opposed sidewalls, the second pair of oppositely opposed sidewalls, and the base defining a basin in which the solution is contained.

15. The system of claim 14 wherein each of the sidewalls of the first pair of oppositely opposed sidewalls is provided with at least one slot which engages with a head of a screw that is used to secure a bezel to which the at least one printhead is mounted to a carriage.

16. The system of claim 15 wherein the slot has a semi-circular shape, the opening of the slot facing towards the basin.

17. The system of claim 14 wherein each of the sidewalls of the first pair of oppositely opposed sidewalls is provided with at least one hole which engages with a head of a screw that is used to secure a bezel to which the at least one printhead is mounted to a carriage.

18. A method of immersing one or more printheads in a waste solution, comprising:

emitting ink from one or more printheads into a tray, the emitted ink now being a waste solution contained in the tray; and immersing the one or more printheads into the waste solution.

19. The method of claim 18 wherein prior to the immersing, emitting a flushing solution from the one or more printheads into the tray, the waste solution being made of the ink and the flushing solution from the one or more printheads.

20. The method of claim 18 wherein the emitting includes emitting ink from a plurality of printheads.

21. The method of claim 18 wherein the emitting ink from a plurality of printheads includes emitting different colored inks from the printheads.

22. The method of claim 18 wherein the immersing includes moving the tray with the waste solution towards the one or more printheads to immerse the one or more printheads in the waste solution.

23. The method of claim 18 further comprising periodically draining the waste solution from the tray.

* * * * *

UNITED STATES PATENT AND TRADEMARK OFFICE

CERTIFICATE OF CORRECTION

PATENT NO. : 6,905,189 B1
DATED : June 14, 2005
INVENTOR(S) : John P. Duffield

It is certified that error appears in the above-identified patent and that said Letters Patent is hereby corrected as shown below:

Column 6,
Lines 49-50, replace “the at least one printhead in” with -- the printhead in --.

Signed and Sealed this

Thirtieth Day of August, 2005

JON W. DUDAS
*Director of the United States Patent and Trademark Office*